US011759755B2

(12) United States Patent
Nakagawa et al.

(10) Patent No.: US 11,759,755 B2
(45) Date of Patent: Sep. 19, 2023

(54) ULTRAFINE BUBBLE GENERATOR

(71) Applicants: AKIMOKU IRON WORKS CO., LTD., Noshiro (JP); AKITA UNIVERSITY, Akita (JP)

(72) Inventors: Akira Nakagawa, Noshiro (JP); Wataru Sugiyama, Akita (JP)

(73) Assignees: AKIMOKU IRON WORKS CO., LTD., Noshiro (JP); AKITA UNIVERSITY, Akita (JP)

( * ) Notice: Subject to any disclaimer, the term of this patent is extended or adjusted under 35 U.S.C. 154(b) by 0 days.

(21) Appl. No.: 17/793,365

(22) PCT Filed: Jan. 29, 2021

(86) PCT No.: PCT/JP2021/003310
§ 371 (c)(1),
(2) Date: Jul. 15, 2022

(87) PCT Pub. No.: WO2021/157485
PCT Pub. Date: Aug. 12, 2021

(65) Prior Publication Data

US 2023/0055123 A1 Feb. 23, 2023

(30) Foreign Application Priority Data

Feb. 6, 2020 (JP) ..... 2020-018434

(51) Int. Cl.
*B01F 3/04* (2006.01)
*B01F 23/2373* (2022.01)
(Continued)

(52) U.S. Cl.
CPC ..... *B01F 23/2373* (2022.01); *B01F 23/232* (2022.01); *B01F 25/104* (2022.01);
(Continued)

(58) Field of Classification Search
CPC ..... B01F 23/232; B01F 23/2373; B01F 23/2375; B01F 25/104; B01F 25/311;
(Continued)

(56) References Cited

U.S. PATENT DOCUMENTS 4,399,027 A * 8/1983 Miller ..... B04C 5/10 209/730
6,382,601 B1 * 5/2002 Ohnari ..... B01F 23/232 261/123

(Continued)

FOREIGN PATENT DOCUMENTS

JP 2005169269 A 6/2005
JP 2008119623 A 5/2008

(Continued)

OTHER PUBLICATIONS

International Search Report (ISR) dated Apr. 20, 2021, issued for International application No. PCT/JP2021/003310. (2 pages).

(Continued)

*Primary Examiner* — Charles S Bushey
(74) *Attorney, Agent, or Firm* — Law Office of Katsuhiro Arai

(57) ABSTRACT

A fine bubble generator which is an ultrafine bubble generator includes a side wall whose inner face is cylindrical, and closing walls closing both ends of the side wall, respectively, with a gas-liquid discharge port in one of the closing walls, wherein a fluid inlet port is provided closer to the gas-liquid discharge port than is a midpoint between both closing walls, and the fluid inlet port penetrates the side wall in a tangential direction of the inner face of the side wall, wherein a spiral groove is formed in the inner face of side wall, and wherein the spiral groove has an angle of inclination of 1° to 10°.

12 Claims, 8 Drawing Sheets

(51) Int. Cl.

| | |
|---|---|
| ***B01F 25/31*** | (2022.01) |
| ***B01F 35/71*** | (2022.01) |
| ***B01F 25/313*** | (2022.01) |
| ***B01F 23/232*** | (2022.01) |
| ***B01F 25/10*** | (2022.01) |
| *B01F 25/00* | (2022.01) |

(52) U.S. Cl.
CPC ..... *B01F 25/311* (2022.01); *B01F 25/3133* (2022.01); *B01F 35/71805* (2022.01); *B01F 2025/9321* (2022.01)

(58) Field of Classification Search
CPC ..... B01F 25/3133; B01F 35/71805; B01F 2025/9321; B01F 2025/913
USPC ..... 261/79.2
See application file for complete search history.

(56) References Cited

U.S. PATENT DOCUMENTS

| | | | | |
|---|---|---|---|---|
| 7,261,283 | B1 | 8/2007 | Ohnari | |
| 8,186,653 | B2 * | 5/2012 | Tsuji | B01F 25/53 261/92 |

FOREIGN PATENT DOCUMENTS

| | | | |
|---|---|---|---|
| JP | 4118939 | B1 | 7/2008 |
| JP | 2008272739 | A | 11/2008 |
| JP | 2009101329 | A | 5/2009 |
| JP | 2010012454 | A | 1/2010 |
| JP | 4420161 | B2 | 2/2010 |
| JP | 2011088045 | A | 5/2011 |

OTHER PUBLICATIONS

International Preliminary Report on Patentability, dated Jul. 28, 2022, for corresponding international application PCT/JP2021/003310 (1 page).
Notification Concerning Transmittal of International Preliminary Report on Patentability, dated Aug. 18, 2022, for corresponding international application PCT/JP2021/003310 (1 page).
Notification of Transmittal of Translation of the International Preliminary Report on Patentability, dated Aug. 18, 2022, for corresponding international application PCT/JP2021/003310 (1 page).
Written Opinion of the International Searching Authority, dated Apr. 20, 2021, for corresponding international application PCT/JP2021/003310 (4 page).

* cited by examiner

[FIG. 1]
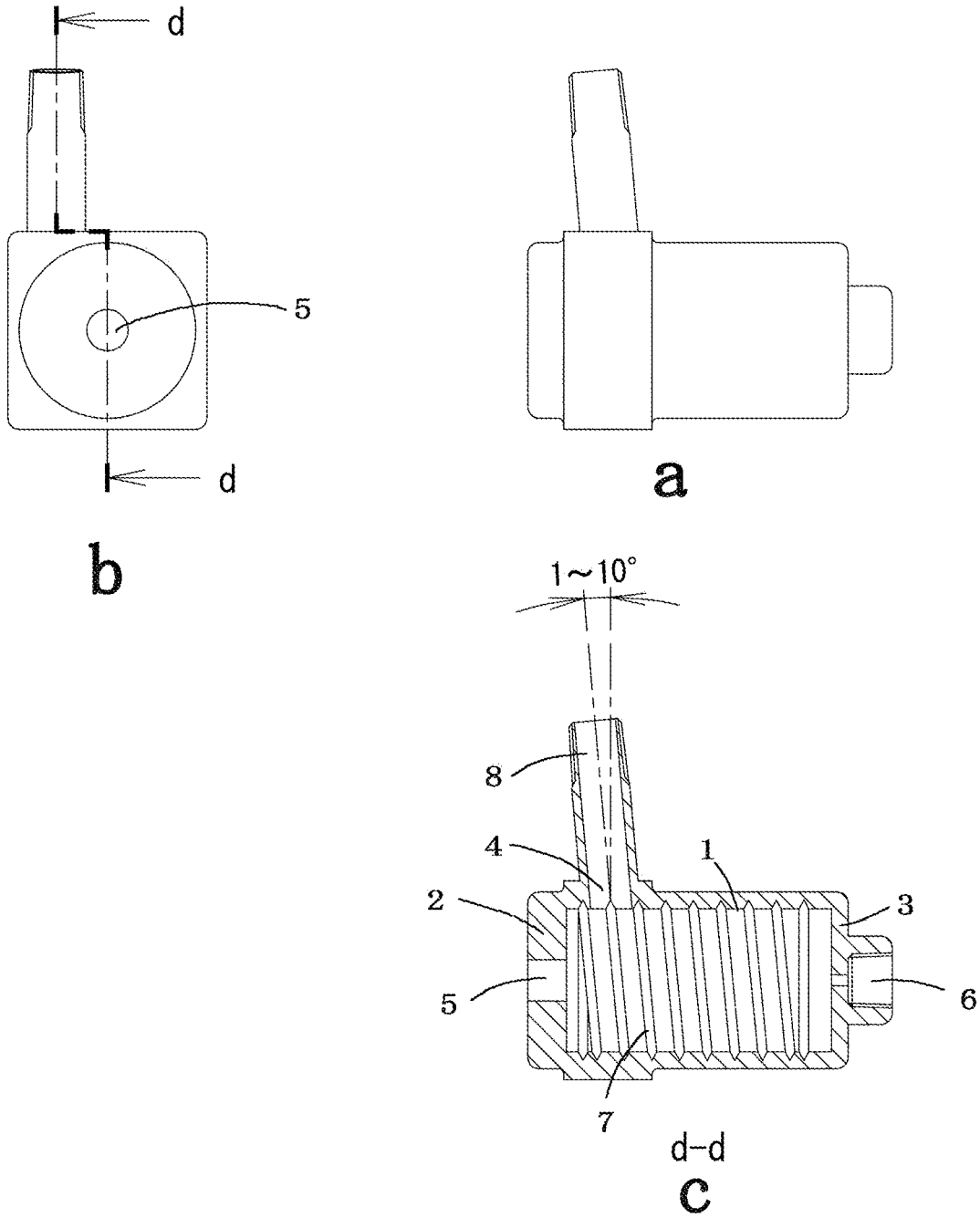

[FIG. 2]
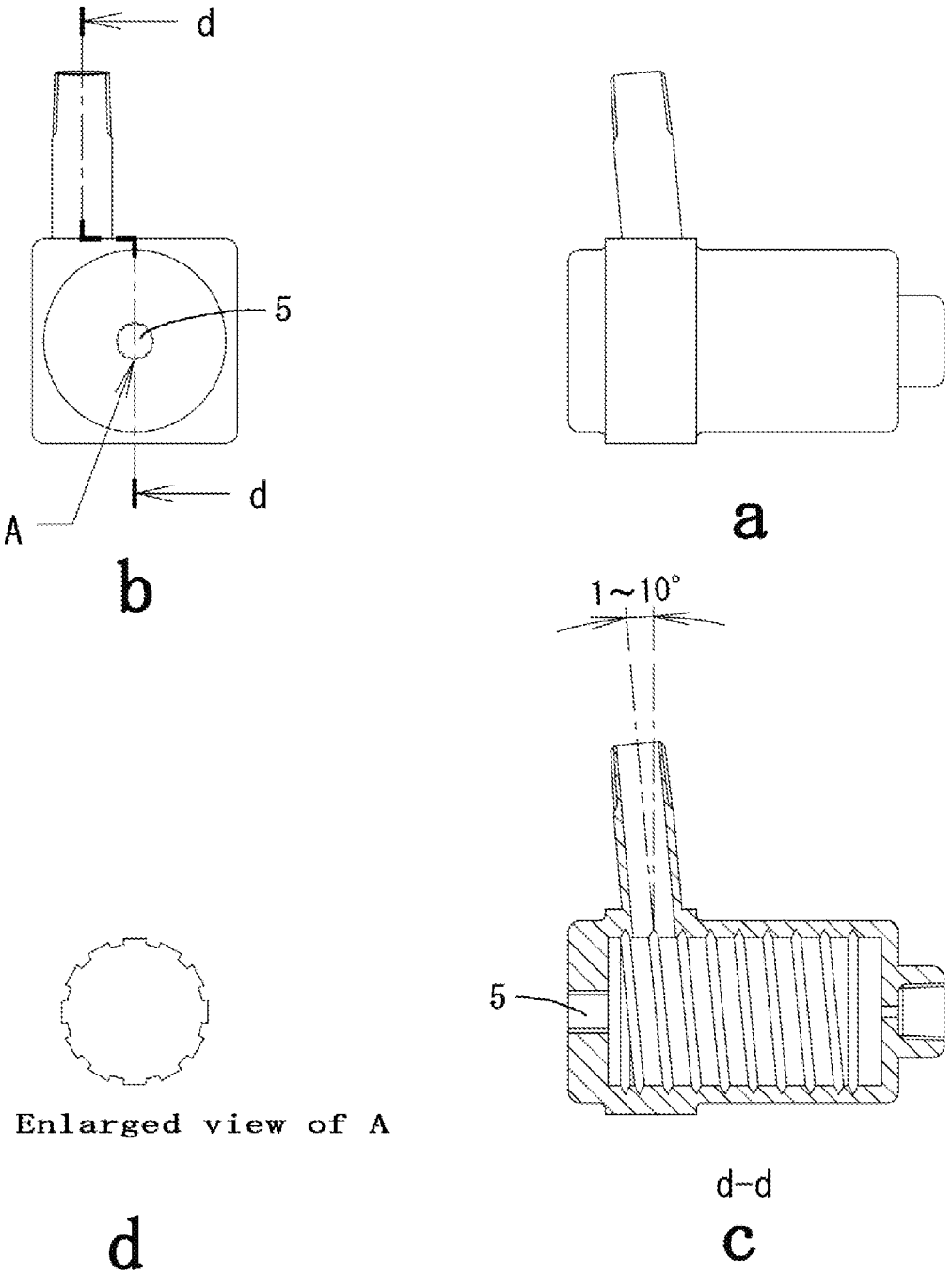

[FIG. 3]
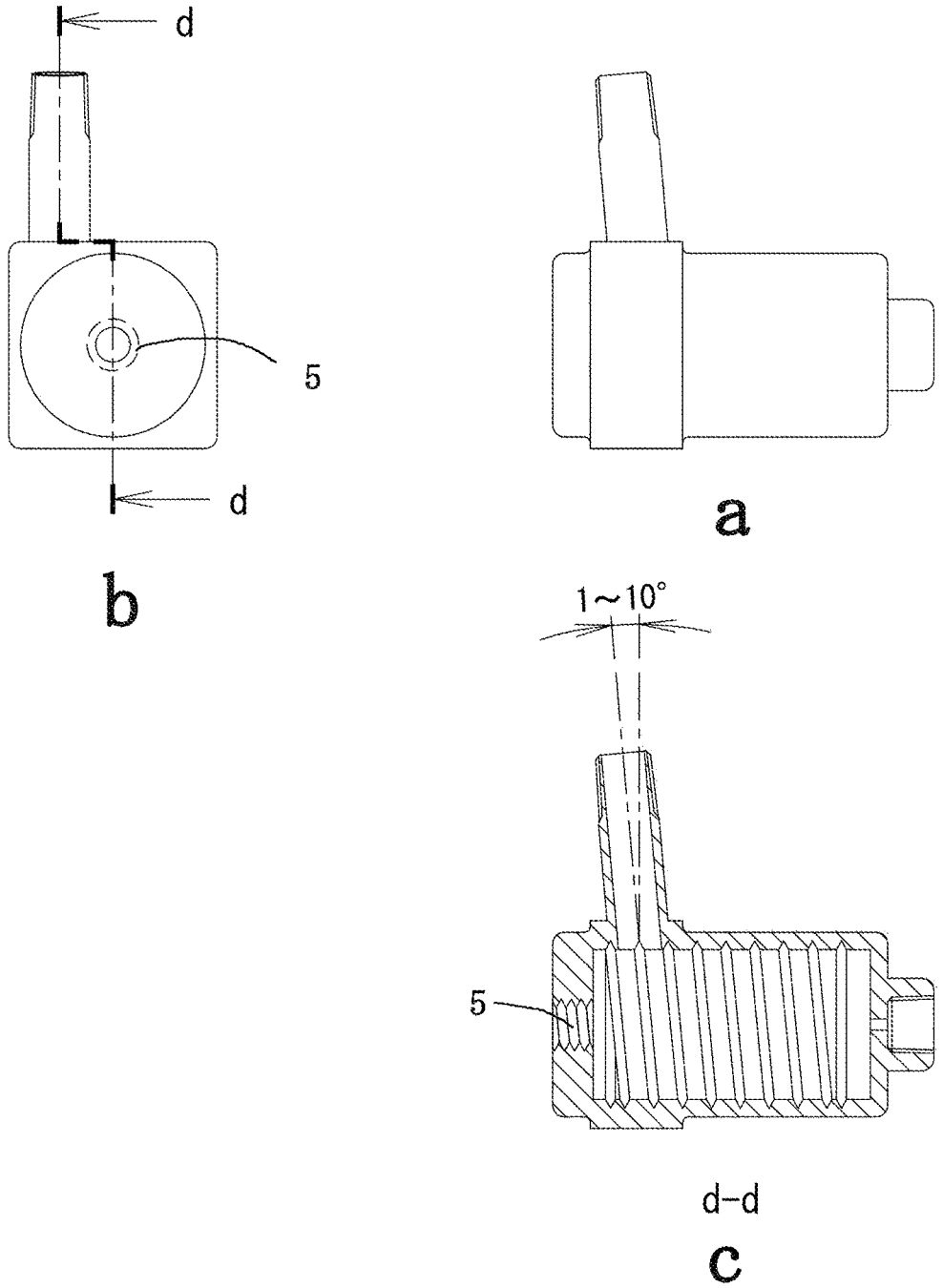

[FIG. 4]
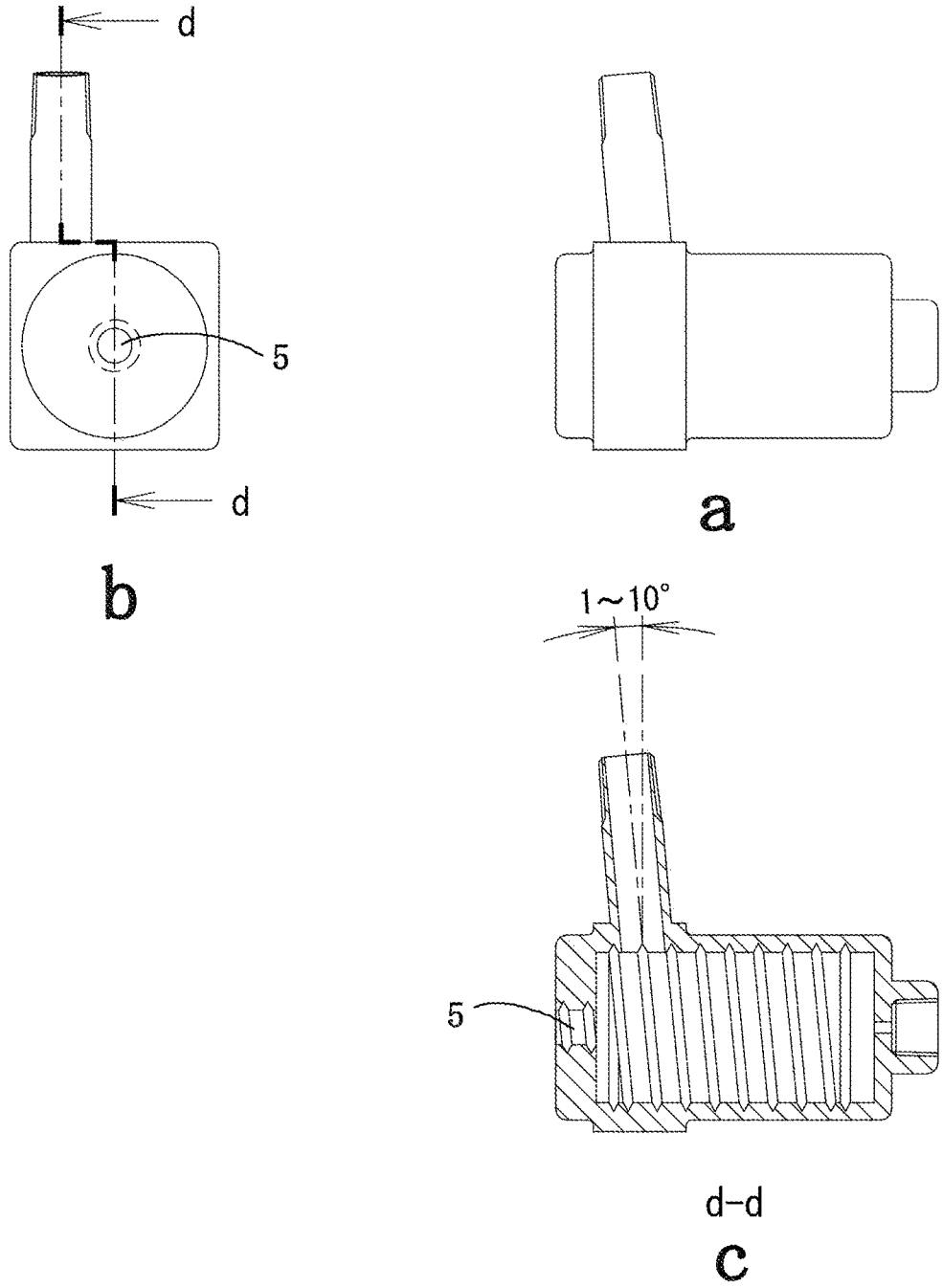

[FIG. 5]
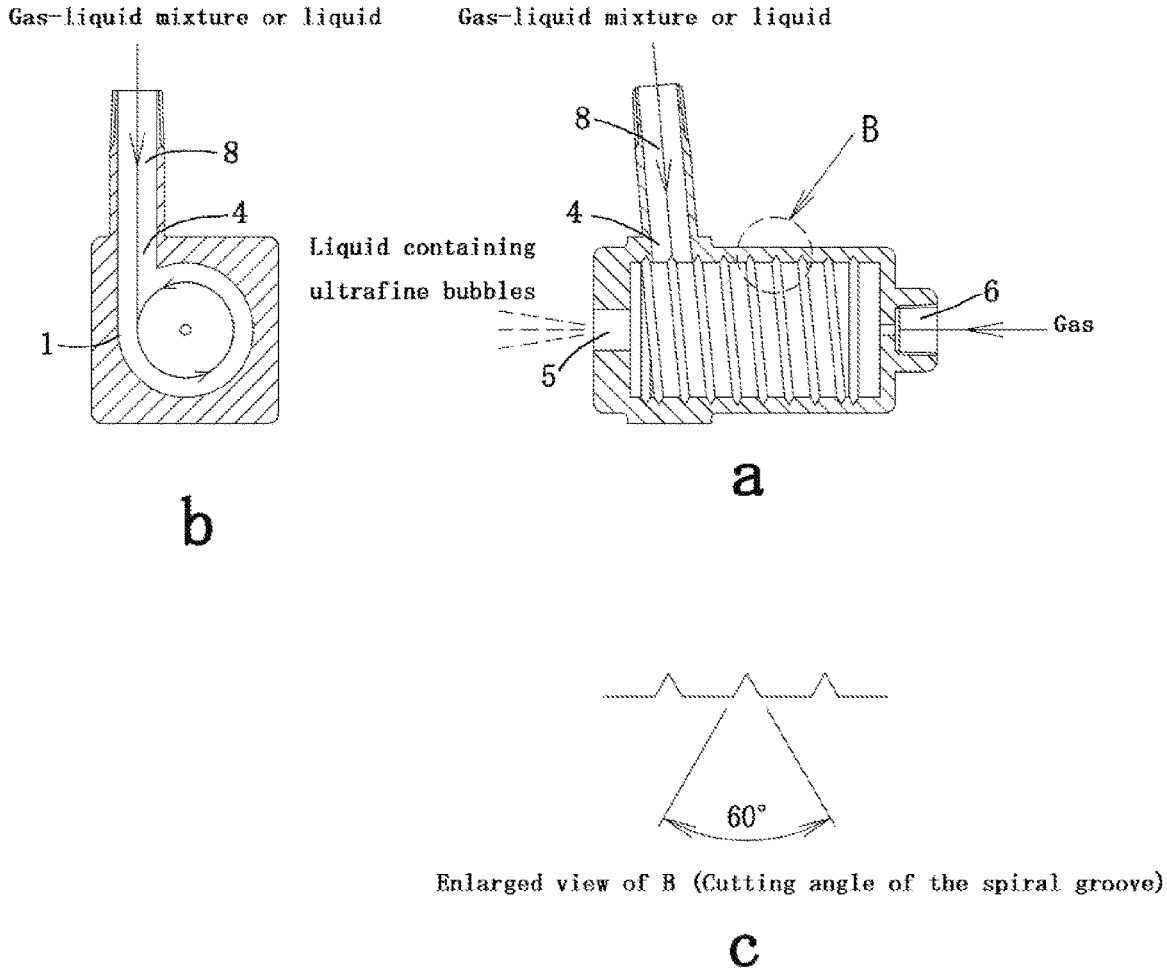

[FIG. 6]
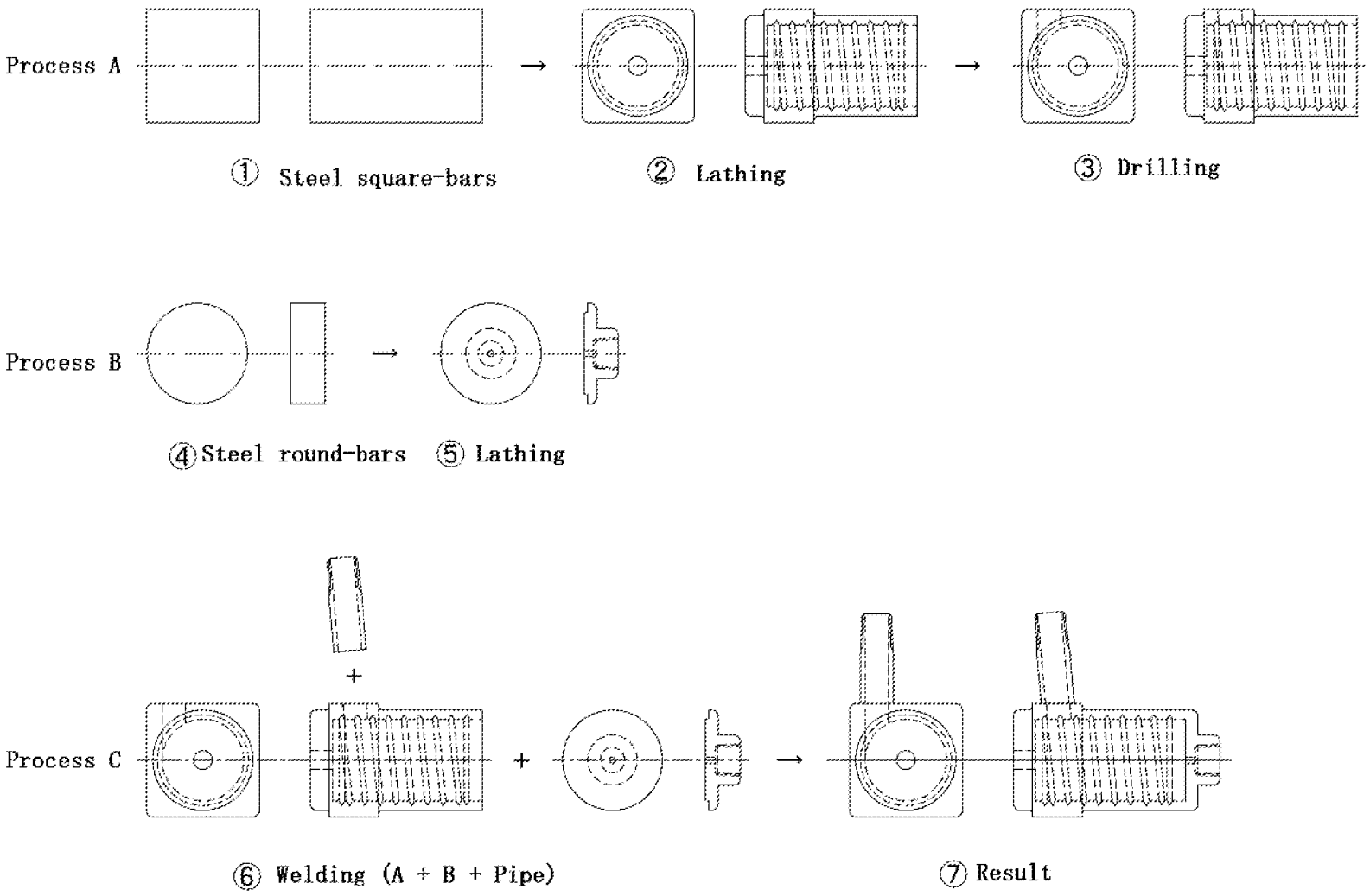

[FIG. 7]
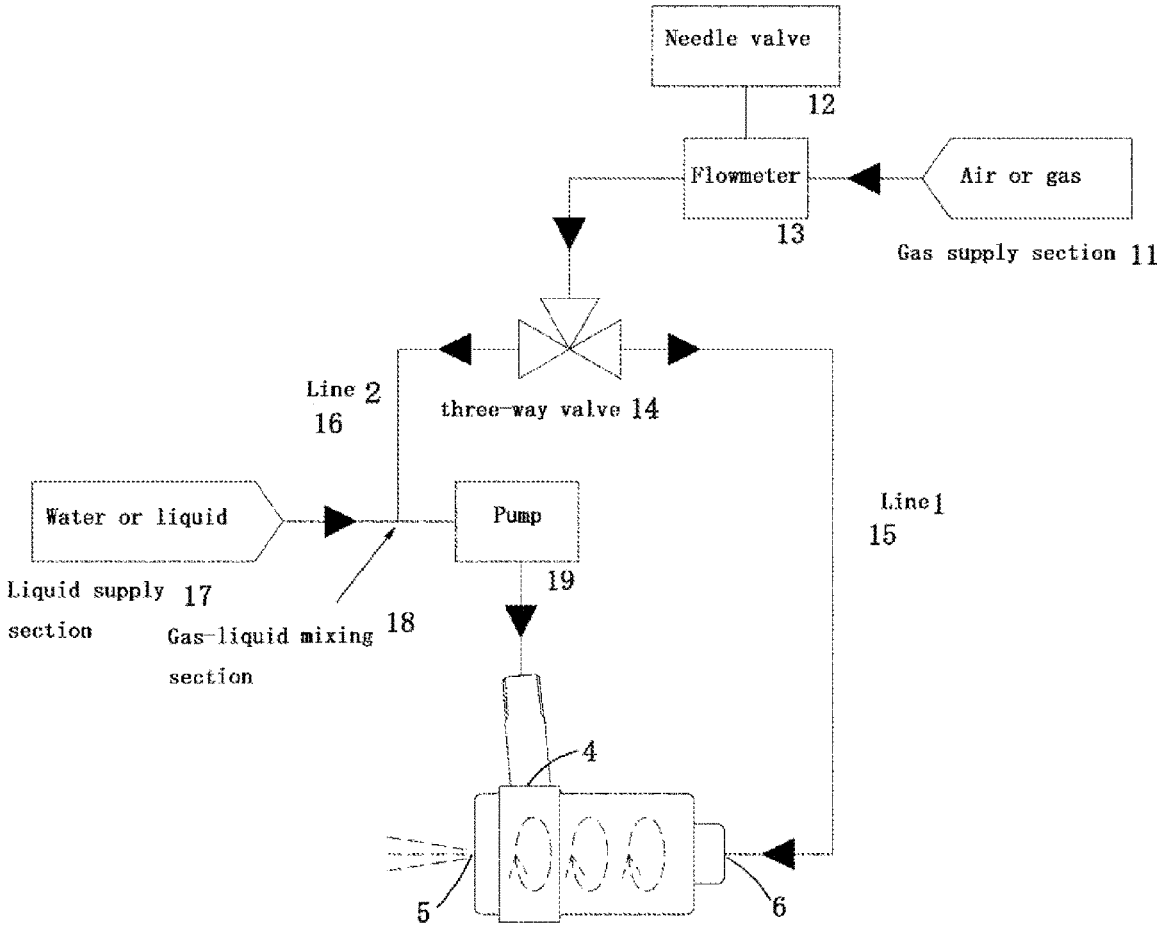

[FIG. 8]
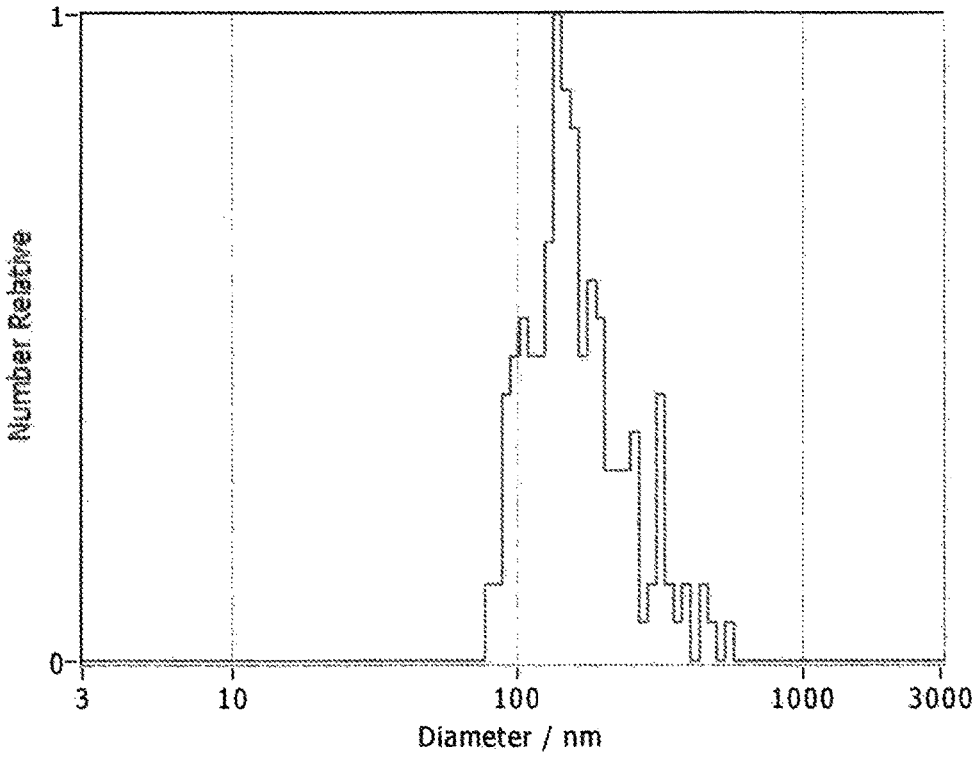
[FIG. 9]
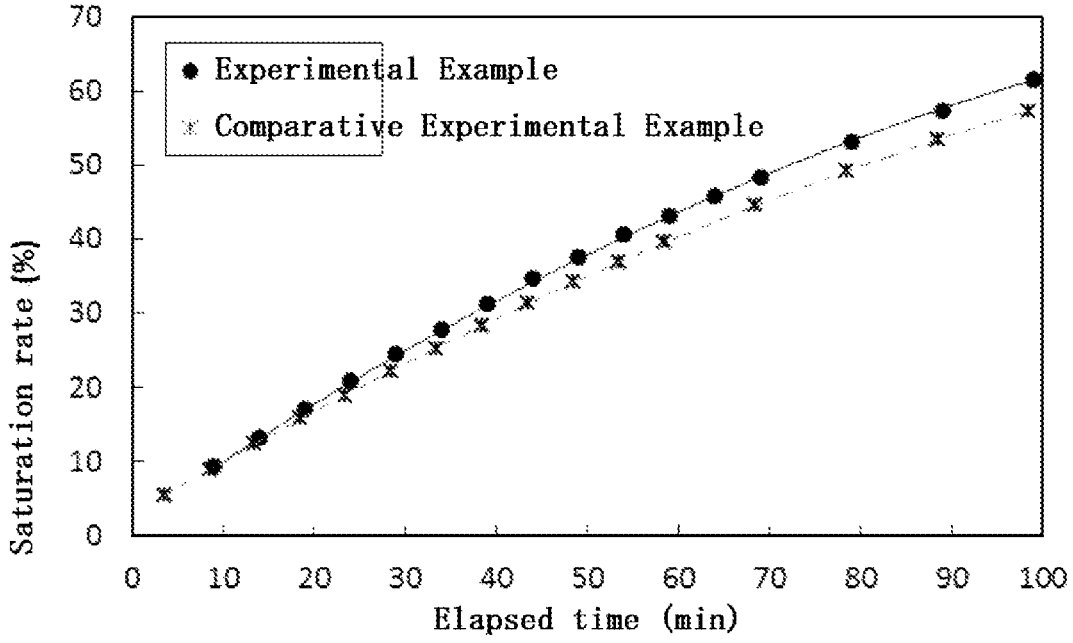
The changes in the oxygen saturation rate with time

ULTRAFINE BUBBLE GENERATOR

CROSS-REFERENCE TO RELATED APPLICATIONS

This application is the U.S. National Phase under 35 U.S.C. § 371 of International Application PCT/JP2021/003310, filed Jan. 29, 2021, which claims priority to Japanese Patent Application No. JP2020-018434, filed Feb. 6, 2020. The International Application was published under PCT Article 21(2) in a language other than English.

TECHNICAL FIELD

The present invention relates to a fine bubble generator, more specifically to a fine bubble generator capable of efficiently producing ultrafine bubbles.

BACKGROUND ART

Fine bubbles are micro bubbles having a particle diameter of approximately 100 μm or less. Fine bubbles are further classified into microbubbles with a particle diameter of approximately 1-100 μm, and ultrafine bubbles with a particle diameter of approximately 1 μm or less. Fine bubbles have specific properties compared with normal bubbles having a particle diameter of 1 mm or more and are utilized in various industrial fields such as agriculture, fishery, medical care, and various manufacturing industries due to the properties. For example, fine bubbles are used for cleaning a wall surface. A floating force acts on the microbubbles; therefore, oil stains, which are "soft deposits" adhered to the wall surface, are adsorbed to the microbubbles so that the oil stains can be removed from the wall surface.

It has been known that ultrafine bubbles with a particle diameter of approximately 1 μm or less also exhibit effects that are not only enhancements of microbubbles. Therefore, studies have been conducted targeting further micronization of bubbles. For example, it has been known that the ultrafine bubbles rapidly permeate into an interface between a solid wall and a stain adhered to the wall surface and into the interior of the stain and have a cleaning effect on "hard deposits" such as adhered salt.

Though a plurality of techniques for producing fine bubbles is known, the most widely used is a swirling liquid flow type (Patent Literature 1) in which a strong swirling liquid flow is generated in a cylindrical vessel to micronize bubbles. By using the swirling liquid flow type, ultrafine bubbles can be produced by a plurality of annular grooves formed on the cylindrical internal side surface of the cylindrical vessel (Patent Literature 2) or by devising a shape of an inner space of the vessel (Patent Literature 3). However, the latter (Patent Literature 3) has the problem that the shape of the inner space is complicated.

CITATION LIST

Patent Literature

[Patent Literature 1] Japanese Patent No. 4420161

[Patent Literature 2] JP2008-272739A

[Patent Literature 3] JP2010-12454A

SUMMARY OF THE INVENTION

Technical Problem

It is an object of the present invention to provide a fine bubble generator capable of efficiently producing ultrafine bubbles while having a relatively simple structure.

Solution to Problem

As a result of various studies to achieve the above object, the present inventors have found that, based on a swirling liquid flow type fine bubble generator, ultrafine bubbles can be efficiently produced with a relatively simple structure, by forming a spiral groove on a cylindrical internal side wall of a fine bubble generator, and by aligning the fluid inlet port's angle of inclination with the spiral groove's angle of inclination, reaching the present invention. That is, the present invention is as follows.

1. An ultrafine bubble generator comprising a cylindrical internal side wall and a closing wall at both ends, with a fluid inlet port in the side wall and a gas-liquid discharge port in one of the closing walls, wherein the fluid inlet port is provided closer to the gas-liquid discharge port than is the middle between both closing walls, said fluid inlet port penetrates the side wall in a tangential direction of the cylindrical internal side wall, and a spiral groove is formed in the cylindrical internal side wall.
2. The fine bubble generator of above-mentioned 1, wherein a spiral groove is formed on the entire cylindrical internal side wall.
3. The fine bubble generator of any one of the above-mentioned 1 or 2, wherein a spiral groove has an angle of inclination of 1° to 10°.
4. The fine bubble generator of any one of the above-mentioned 1 to 3, wherein the angle of inclination of the fluid inlet port is approximately the same as the angle of inclination of a spiral groove.
5. The fine bubble generator of any one of the above-mentioned 1 to 4, wherein a groove is formed on the interior wall of the gas-liquid discharge port.
6. The fine bubble generator of any one of the above-mentioned 1 to 5, wherein the other closing wall is provided with a gas inlet port.
7. A fine bubble generating system which supplies gas and liquid to the fine bubble generator of the above-mentioned 6 to generate fine bubbles, provided with a pathway which directly supplies the gas from the gas supply section through gas inlet port, and a pathway which supplies the gas from said gas supply section through gas-liquid mixing section, pump, and the fluid inlet port in a gas-liquid mixed state, and with a switching valve, between the said gas supply section and the said gas-liquid mixing section, which can selectively switch both the pathways.

Advantageous Effects of Invention

By using the fine bubble generator of the present invention, ultrafine bubbles can be efficiently produced although the fine bubble generator has a relatively simple structure.

BRIEF DESCRIPTION OF DRAWINGS

FIG. 1 shows an embodiment of a fine bubble generator of the present invention. (a) is a side view, (b) is a front view, and (c) is a cross-sectional view taken along the line d-d in (b).

FIG. 2 shows an embodiment of a fine bubble generator of the present invention. (a) is a side view, (b) is a front view, (c) is a cross-sectional view taken along the line d-d in (b), and (d) is an enlarged view of the gas-liquid discharge port 5. It differs from FIG. 1 only in that the interior wall of the gas-liquid discharge port has a rectangular groove in a gear shape.

FIG. 3 shows an embodiment of a fine bubble generator of the present invention. It differs from FIG. 1 only in that a spiral groove is formed on the interior wall of the gas-liquid discharge port 5.

FIG. 4 shows an embodiment of a fine bubble generator of the present invention. It differs from FIG. 1 only in that a threaded groove is formed on the interior wall of the gas-liquid discharge port 5.

FIG. 5 shows the flow of generating fine bubbles in the fine bubble generator of FIG. 1. (a) is a cross-sectional view similar to FIG. 1, (b) is a cross-sectional view taken along the plane parallel to the front surface, and (c) is an enlarged view of the spiral groove.

FIG. 6 shows manufacturing process of the fine bubble generator of the present invention.

FIG. 7 shows schematic diagram of the fine bubble generating system of the present invention.

FIG. 8 shows particle diameter distribution of micro bubbles generated by the fine bubble generator of the present invention.

FIG. 9 shows the increase in oxygen saturation rate when micro bubbles are generated by the fine bubble generator of the present invention (Experimental Example) and when micro bubbles are generated by a fine bubble generator with no spiral groove on the internal side walls and no inclined fluid introduction port (Comparative Experimental Example).

DESCRIPTION OF EMBODIMENT

Hereinafter, the present invention will be described in detail with reference to examples, but the present invention is not limited to the examples.

FIGS. 1 to 4 illustrate embodiments of the fine bubble generator of the present invention, and FIG. 5 represents the flow of the generation of fine bubbles when the fine bubble generator of FIG. 1 is used.

The fine bubble generator of the present invention is a so-called swirling liquid flow type fine bubble generator. Referring to FIG. 1, the fine bubble generator of the present invention has an internal space enclosed by a cylindrical internal side wall 1, one of the closing walls 2, and the other closing wall 3, with a fluid inlet port 4, which penetrates the side wall tangentially to the cylindrical internal side wall (FIG. 5*b*), and one of the closing walls 2 is provided with a gas-liquid discharge port 5. Referring to FIG. 1, other closing wall 3 is also provided with a gas inlet port 6, but this may or may not be provided. In addition, the closing wall is not necessarily flat, and it may be dome-shaped or spindle-shaped. Further, as described later, the fine bubble generator having a rectangular cross-section (FIG. 1*c*) may have a parallelogram cross-section by tilting the closing wall in accordance with the inclination of the spiral groove, which is formed on the internal side wall.

Since the fine bubble generator of the present invention has a cylindrical internal side wall 1, the inside of the side wall is cylindrical, but the outside of the side wall does not necessarily have to be cylindrical. For example, the inside of the side wall may be cylindrical, and the outside of the side wall may be polygonal columnar, particularly quadrangular columnar, which facilitates processing during manufacturing.

The fluid inlet side port 4 of the side wall of the fine bubble generator of the present invention is provided as it penetrates the side wall in a tangent direction of the cylindrical internal side wall 1 (FIG. 5 *b*). A strong swirl flow can be generated by injecting with pressure gas-liquid mixture or liquid in the tangent direction. The position of the fluid inlet side port 4 is provided closer to the gas-liquid discharge port 5 than is the middle between both closing walls.

The gas-liquid mixture is injected with pressure tangentially to the cylindrical internal side wall 1 from the fluid inlet wall 4 and swirls at high speed (FIG. 5 *b*), resulting in enhanced bubble micronization, and liquid containing ultra-fine bubbles is discharged from the gas-liquid discharge port 5. In the case of providing the gas inlet port 6, gas may be introduced from the gas inlet port, and liquid may be injected with pressure from the fluid inlet port. The gas and the liquid used may be an air-water system, oxygen-water system, and the like.

The fine bubble generators illustrated in FIGS. 2 to 4 are different from those illustrated in FIG. 1 only in the interior wall structure of the gas-liquid discharge port 5.

Spiral groove 7 is formed on the cylindrical internal side wall 1 of the fine bubble generator of the present invention (for example, FIG. 1*c*). By forming the spiral groove, a shear is generated between the spiral groove and the swirling flow, enabling micronizing of the bubbles. The spiral groove may be formed on a part of the cylindrical internal side wall 1, but it is preferably formed on the entire cylindrical internal side wall. The angle of inclination of the spiral groove 7 is preferably 1° to 10° (see FIG. 1*c*) and preferably 1° to 5°. The angle of inclination 1° to 10° can make it easier to maintain the swirling ability of the gas-liquid mixture or the liquid injected with pressure. The shape and depth of the spiral groove 7 are not particularly restricted. For example, the shape may be an isosceles triangle or an equilateral triangle in cross-section (FIG. 5*c*).

It is preferable that the angle of inclination of the fluid inlet side port 4 provided on the side wall be the same as the angle of inclination of the spiral groove 7 (for example, in FIG. 1, the angle of inclinations of both (the angle between the arrows) are the same), because it is considered that when the angle of inclination of the fluid inlet port 4 and the angle of inclination of the spiral groove 7 are the same, the flow of the fluid is less likely to be disturbed and the swirling ability of the fluid is less likely to be impaired.

Further, in order to make it easier to align the fluid flow direction and the angle of inclination of the spiral groove, it is preferable to provide a fluid inlet path 8, which continues to the fluid inlet port 4, extends in approximately the same direction as the fluid inlet port 4, and has approximately the same inner diameter as the fluid inlet port 4 in a hollow shape. The fluid flow can be directed by passing through the fluid inlet path 8.

Note that the inclination angles of the spiral groove 7, the fluid inlet port 4, and the fluid introduction path 8 are not required to be strictly the same. A slight deviation is allowed as long as the flow of the fluid is not disturbed, for example, within ±0.5°.

The angle of inclination of spiral groove 7 has two different windings. For example, the same 5° angle of direction may be anticlockwise or clockwise. It is preferable that the spiral winding direction be the one in which the angle of inclination of the fluid inlet port 4 is aligned with the angle of inclination of the groove on a part of the internal side wall 1, which provides the fluid inlet port 4. (FIG. 1 shows the anticlockwise winding, which is such a winding direction. If fluid inlet port 4 is provided on the right upper surface instead of the left upper surface in FIG. 1B, the clockwise winding is such a winding direction.) The amount of generated ultrafine bubbles, which are considered difficult to float due to their infinitesimal particle diameter, can be estimated to some extent by measuring the dissolved oxygen content, and a result shows that such a spiral winding direction has higher effectiveness of increasing dissolved oxygen content (data omitted), so it is presumed that ultrafine bubbles can be efficiently produced.

The gas-liquid discharge port 5 penetrates through one of the closing walls 2, and it is preferable that a groove be formed in an interior wall of the through-hole. When fine bubbles are discharged from the gas-liquid discharge port, a shearing force is strongly exerted by the groove, further promoting the bubbles' micronization.

The shape of the groove is not restricted; the shape of the groove may be formed as a rectangular groove in a gear shape (FIG. 2), a coarse or fine thread groove (FIG. 3), or a spiral groove (FIG. 4).

The fine bubble generator is manufactured as follows.

FIG. 6 shows the steps of manufacturing the fine bubble generator.

Process A shows the manufacturing process of the main body of the fine bubble generator. External and internal cutting of steel square-bars is performed using a lathe, and then drilling is performed using a drilling machine to manufacture the main body.

Process B shows the manufacturing process of the closing wall of the fine bubble generator. External and internal cutting of steel round-bars is performed using a lathe to manufacture the closing wall.

Process C shows the welding process of fine bubble generator parts. The main body manufactured in the process A, the closing wall manufactured in the process B, and a commercially available pipe are joined by welding.

A fine bubble generator is completed through processes A, B, and C.

Regarding the difficulties in manufacturing the fine bubble generator, the internal side wall is cylindrical and does not have a complicated shape. The processes are not difficult to form a spiral groove in the internal side wall, incline the fluid inlet port, or form a groove on the internal side wall of the gas-liquid discharge port. Compared with a mirror-finishing which sometimes is performed on the internal side wall, the spiral groove can also be easily formed by lathing. While the various contrivances have been introduced in the fine bubble generator, it can be said that the structure is relatively simple.

It is necessary to assemble a fine bubble generation system to supply gas and liquid to a fine bubble generator to produce fine bubbles (for example, FIG. 7). In the fine bubble generation system, the gas may be injected with pressure as a gas-liquid mixture from the fluid inlet port 4 without providing the line 1, or conversely, the gas may be introduced from the gas inlet port 6, and the liquid may be injected with pressure from the fluid inlet port 4 without providing the line 2. In FIG. 7, both can be selected by providing a switching valve such as a three-way valve. By providing the switching valve, usually, line 1 is closed, and the gas-liquid mixture is supplied from the fluid inlet port 4 through line 2, and in some cases, line 2 is closed, and the gas is introduced from the gas inlet port 6 through line 1. Having only the liquid flow into the pump by closing line 2, corrosion inside the pump can be prevented in the case of using a corrosive type of gas.

Furthermore, the needle valve 12 and flowmeter 13 may be provided immediately after the gas supply section to adjust the amount of gas introduced. When a float type flowmeter is used, the gas flow rate can be checked at any time, even during operation, enabling fine adjustment of the gas introduction amount and stable production of fine bubbles.

The fine bubble generator of the present invention efficiently produces ultrafine bubbles, and in order to further increase the proportion of ultrafine bubbles, the liquid containing ultrafine bubbles produced by the fine bubble generator of the present invention may be returned to the fine bubble generator of the present invention to be used as a circulating type fine bubble generation system.

EXAMPLES

It was examined whether the fine bubble generator of the present invention could efficiently produce ultrafine bubbles.

Example 1

Fine bubbles were produced using the fine bubble generator of FIG. 1, which is the fine bubble generator of the present invention, and the particle diameter distribution of the resulting micro bubbles was measured.

(1) Experimental Method (I) Production of Fine Bubbles Using the Fine Bubble Generator of the Present Invention The fine bubble generator shown in FIG. 1 is used, and the angle of inclination of the spiral groove 7, fluid inlet port 4, and fluid inlet path 8 were aligned at 5°. This fine bubble generator was placed in 6 L of pure water in a glass container with a capacity of 10 L.

Meanwhile, the fine bubble generating system shown in FIG. 7 was assembled, and air was supplied from the gas supply section 11, passed through the flowmeter 13 equipped with the needle valve 12, then the three-way valve 14, merged with pure water at the gas-liquid mixing section 18, passed through the pump 19, and the mixture of air and pure water was introduced into the fine bubble generator from the fluid inlet port 4. At this time, the tree-way valve on the line 1 side was closed. Micro bubbles were produced in the fine bubble generator, and the micro bubbles were discharged from the gas-liquid discharge port 5 into pure water in a glass container. The pure water containing the micro bubbles was sucked up by a hose, sent again from the liquid supply section 17 to the gas-liquid mixing section 18, merged with air, inserted into the fine bubble generator, and circulated. The introduction amount of air was 0.1 L/min, the flow rate of pure water was 6 L/min, and the operation time of the pump was 30 minutes. After the pump was stopped, pure water containing micro bubbles in the glass container was collected and used as a sample.

(II) Measurement of Particle Diameter of Micro Bubbles

The particle diameter of the sample micro bubbles of this experimental example was measured by a nanoparticle Brownian motion tracking method, using a dynamic light scattering (DLS) particle diameter distribution measuring device. The DLS measuring device used was a Zeta View-PMX100SP manufactured by MicrotracBEL Corp. The micro bubbles particle diameter distribution was obtained from the micro bubbles' particle diameters measurements.

(2) Results

The particle diameter distribution of microbubbles obtained by the measurement is shown in FIG. 8. The vertical axis represents the relative number of bubbles, and the horizontal axis represents the bubbles' particle diameter. The particle diameters of all bubbles are smaller than 1000 μm, with the peak particle diameter being 145.3 μm and the average particle diameter being 176.4 μm. These diameters are sufficiently small, indicating that ultrafine bubbles can be efficiently produced by the fine bubble generator of the present invention.

Example 2

Fine bubbles were produced by using the fine bubble generator of FIG. 1 of the present invention (experimental example) and a fine bubble generator of FIG. 1. With no spiral groove 7 provided on the cylindrical internal side wall 1, no inclination (the angle of inclination: 0°) provided for the fluid inlet port 4 and the fluid inlet path 8 (comparative experimental example). The content of dissolved oxygen was measured and compared to compare the bubble refining abilities of the two generators.

(1) Experimental Method (I) Production of Fine Bubbles for the Experimental Example and Measurement of Dissolved Oxygen Content The fine bubble generator shown in FIG. 1 was used. The angle of inclination of the spiral groove 7, the fluid inlet port 4, and the fluid inlet path 8 were aligned to 5°. This fine bubble generator was placed in a water tank containing 90 L of water.

The fine bubble generation system used in the experiment will be explained using FIG. 7 as it is essentially the same structure shown in FIG. 7, except that there is no three-way valve. Line 1 and line 2 are each equipped with a valve, and gas is supplied via a flowmeter and either line 1 or line 2's valve. Air from line 2 in FIG. 7 is merged with water at the gas-liquid mixing section 18, passed through the pump 19, and from the liquid inlet port 4, a mixture of air and water is introduced into the fine bubble generator (at this time, the valve on the line 1 side was closed.) Micro bubbles are produced in the fine bubble generator, and the microbubbles are discharged into the water in the tank from the gas-liquid discharge port 5. The water containing the micro bubbles is sucked up by a hose, sent again from the liquid supply section 17 to the gas-liquid mixing section 18, merged again with air, sent to the fine bubble generator and circulated.

In this experiment, first, the pump was operated to circulate water without intaking air. In this state, sodium sulfite was added to the water tank to reduce the content of dissolved oxygen in the water to close to 0 mg/L. Then, when it is estimated to be the time of increasing the content of dissolved oxygen again, the valve on the air supply (line 2) side was opened, and air (0.5% or less based on the water flow rate) was merged with the water to generate fine bubbles.

The content of dissolved oxygen change increased by discharged bubbles into the water with time was measured by a fluorescent dissolved oxygen meter.

(II) Production of Fine Bubbles for the Comparative Experimental Example and Measurement of Dissolved Oxygen Content The content of dissolved oxygen at the comparative experimental example was measured similarly to the experimental example, except that the fine bubble generator had no spiral groove 7 on the cylindrical internal side wall, and no inclination (the angle of inclination 0°) of the fluid inlet port 4 and the fluid inlet path 8.

(2) Results

The measured dissolved oxygen content was divided by the saturation value at that water temperature to obtain the oxygen saturation rate. The changes in the oxygen saturation rate with time are shown in FIG. 9. For easier comparison, the time on the horizontal axis is adjusted to have the oxygen saturation rate of approximately 10% at 10 minutes in both examples.

The comparison of the two experiments indicates that the oxygen saturation rate's increasing speed is higher in the experimental example than in the comparative experimental example. In the case of the same amount of gas added into the water, a smaller diameter of gas (bubble) is more effective in dissolving oxygen into the water because its surface area per volume increases as its diameter decreases. The bubbles discharged into the water have a variety of particle diameters. It is thought that the distribution of the bubbles gravitates to the smaller particle diameter, resulting in a higher oxygen saturation rate's increasing speed.

The above results indicate that the experimental example is more efficient in generating bubbles with smaller particle diameters than the comparative experimental example.

INDUSTRIAL APPLICABILITY

Because fine bubbles with small particle diameters can be efficiently produced by using the fine bubble generator of the present invention, it is beneficial in industrial fields where ultrafine bubbles are expected to be applied, such as wall cleaning.

The invention claimed is:

1. An ultrafine bubble generator comprising a side wall whose inner face is cylindrical, and closing walls closing both ends of the side wall, respectively, with a gas-liquid discharge port in one of the closing walls, wherein a fluid inlet port is provided closer to the gas-liquid discharge port than is a midpoint between both closing walls, and the fluid inlet port penetrates the side wall in a tangential direction of the inner face of the side wall, wherein a spiral groove is formed in the inner face of the side wall, and wherein the spiral groove has an angle of inclination of 1° to 10° relative to a plane orthogonal to a longitudinal axis of the spiral groove.

2. The ultrafine bubble generator of claim 1, wherein a groove is formed on the interior wall of the gas-liquid discharge port.

3. The ultrafine bubble generator of claim 2, wherein the other closing wall is provided with a gas inlet port.

4. An ultrafine bubble generating system which supplies gas and liquid to the ultrafine bubble generator of claim 3 to generate ultrafine bubbles, provided with a first pathway which directly supplies the gas from a gas supply section through gas inlet port, and a second pathway which supplies the gas from said gas supply section through a gas-liquid mixing section, pump, and the fluid inlet port in a gas-liquid mixed state, and with a switching valve between the said gas supply section and the said gas-liquid mixing section, which can selectively switch both the pathways.

5. The ultrafine bubble generator of claim 1, wherein the other closing wall is provided with a gas inlet port.

6. An ultrafine bubble generating system which supplies gas and liquid to the ultrafine bubble generator of claim 5 to generate ultrafine bubbles, provided with a first pathway which directly supplies the gas from a gas supply section through gas inlet port, and a second pathway which supplies the gas from said gas supply section through a gas-liquid mixing section, pump, and the fluid inlet port in a gas-liquid mixed state, and with a switching valve between the said gas supply section and the said gas-liquid mixing section, which can selectively switch both the pathways.

7. An ultrafine bubble generator comprising a side wall whose inner face is cylindrical, and closing walls closing both ends of the side wall, respectively, with a gas-liquid discharge port in one of the closing walls, wherein a fluid inlet port is provided closer to the gas-liquid discharge port than is a midpoint between both closing walls, and the fluid inlet port penetrates the side wall in a tangential direction of the inner face of the side wall, wherein a spiral groove is formed in the inner face of the side wall, and wherein an angle of inclination of the fluid inlet port is approximately the same as an angle of inclination of the spiral groove as measured relative to a plane orthogonal to a longitudinal axis of the spiral groove.

8. The ultrafine bubble generator of claim 7, wherein a groove is formed on the interior wall of the gas-liquid discharge port.

9. The ultrafine bubble generator of claim 8, wherein the other closing wall is provided with a gas inlet port.

10. An ultrafine bubble generating system which supplies gas and liquid to the ultrafine bubble generator of claim 9 to generate ultrafine bubbles, provided with a first pathway which directly supplies the gas from a gas supply section through gas inlet port, and a second pathway which supplies the gas from said gas supply section through a gas-liquid mixing section, pump, and the fluid inlet port in a gas-liquid mixed state, and with a switching valve between the said gas supply section and the said gas-liquid mixing section, which can selectively switch both the pathways.

11. The ultrafine bubble generator of claim 7, wherein the other closing wall is provided with a gas inlet port.

12. An ultrafine bubble generating system which supplies gas and liquid to the ultrafine bubble generator of claim 11 to generate ultrafine bubbles, provided with a first pathway which directly supplies the gas from a gas supply section through gas inlet port, and a second pathway which supplies the gas from said gas supply section through a gas-liquid mixing section, pump, and the fluid inlet port in a gas-liquid mixed state, and with a switching valve between the said gas supply section and the said gas-liquid mixing section, which can selectively switch both the pathways.

* * * * *